US006374749B1

(12) United States Patent
Duncan et al.

(10) Patent No.: US 6,374,749 B1
(45) Date of Patent: Apr. 23, 2002

(54) FRICTION WEDGE FOR A RAILROAD CAR TRUCK HAVING A REPLACEABLE WEAR MEMBER

(75) Inventors: Scott R. Duncan, Lake Zurich; Robert M. Irving, Bartlett; Valerian S. Skawinski, Elmhurst, all of IL (US)

(73) Assignee: NACO, Inc., Lombard, IL (US)

( * ) Notice: Subject to any disclaimer, the term of this patent is extended or adjusted under 35 U.S.C. 154(b) by 0 days.

(21) Appl. No.: 09/414,368

(22) Filed: Oct. 7, 1999

(51) Int. Cl.[7] ..... B61F 5/00
(52) U.S. Cl. ..... 105/198.5
(58) Field of Search ..... 105/157.1, 198.2, 105/198.3, 198.4, 198.5

(56) References Cited

U.S. PATENT DOCUMENTS

| | | | | |
|---|---|---|---|---|
| 2,497,460 A | | 2/1950 | Leese | |
| 2,827,987 A | | 3/1958 | Williams | |
| 3,024,743 A | * | 3/1962 | Williams et al. | 105/198.3 |
| 3,218,990 A | | 11/1965 | Weber | |
| 3,461,815 A | | 8/1969 | Gedris et al. | |
| 3,559,589 A | | 2/1971 | Williams | |
| 3,575,117 A | | 4/1971 | Tack | |
| 3,670,660 A | | 6/1972 | Weber et al. | |
| 3,802,353 A | | 4/1974 | Korpics | |
| 3,834,320 A | | 9/1974 | Tack | |
| 3,855,942 A | | 12/1974 | Mulcahy | |
| 3,857,341 A | | 12/1974 | Neumann | |
| 3,880,089 A | | 4/1975 | Wallace | |
| 3,901,163 A | | 8/1975 | Neumann | |
| 3,905,305 A | | 9/1975 | Cope | |
| 3,977,332 A | | 8/1976 | Bullock | |
| 4,915,031 A | * | 4/1990 | Wiebe | 105/198.2 |
| 4,986,192 A | | 1/1991 | Wiebe | |
| 5,027,716 A | | 7/1991 | Weber et al. | |
| 5,511,489 A | | 4/1996 | Bullock | |
| 5,555,817 A | | 9/1996 | Taillon et al. | |
| 5,555,818 A | | 9/1996 | Bullock | |
| 5,850,795 A | | 12/1998 | Taillon | |

OTHER PUBLICATIONS

NACO Technologies Drawing No. 50330 dated Nov. 30, 1979.

* cited by examiner

*Primary Examiner*—Mark T. Le
(74) *Attorney, Agent, or Firm*—Lee, Mann, Smith, McWilliams, Sweeney & Ohlson

(57) ABSTRACT

A friction wedge for a railroad car truck including a body and a wear member. The body includes a front face having a pocket adapted to removably receive the wear member. The pocket includes a bottom wall and a peripheral side wall extending outwardly from the bottom wall. The wear member includes a wear pad having a first wall and a connector member such as an adhesive layer attached to the first wall. The connector member removably attaches the first wall of the wear pad to the body. The peripheral side wall of the pocket extends around a side wall of the wear pad and prevents lateral sliding movement of the pad member with respect to the bottom wall of the pocket. The wear pad includes a second wall that is adapted to slidably engage the side frame of a railroad car truck to provide dampened movement of the bolster of the truck. The wear pad may be easily removed from the pocket when worn and replaced with a new wear pad while the body may be reused.

25 Claims, 7 Drawing Sheets

FIG. 3
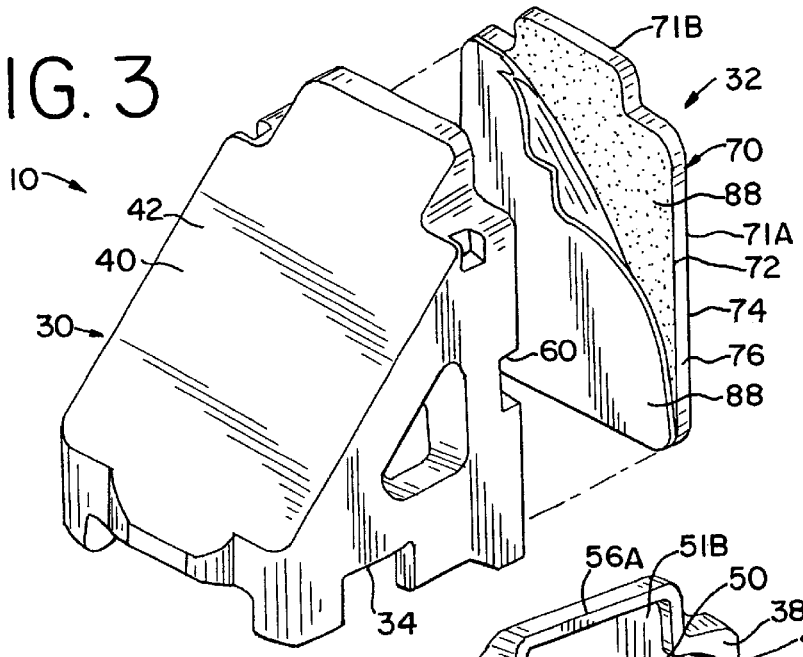
FIG. 4
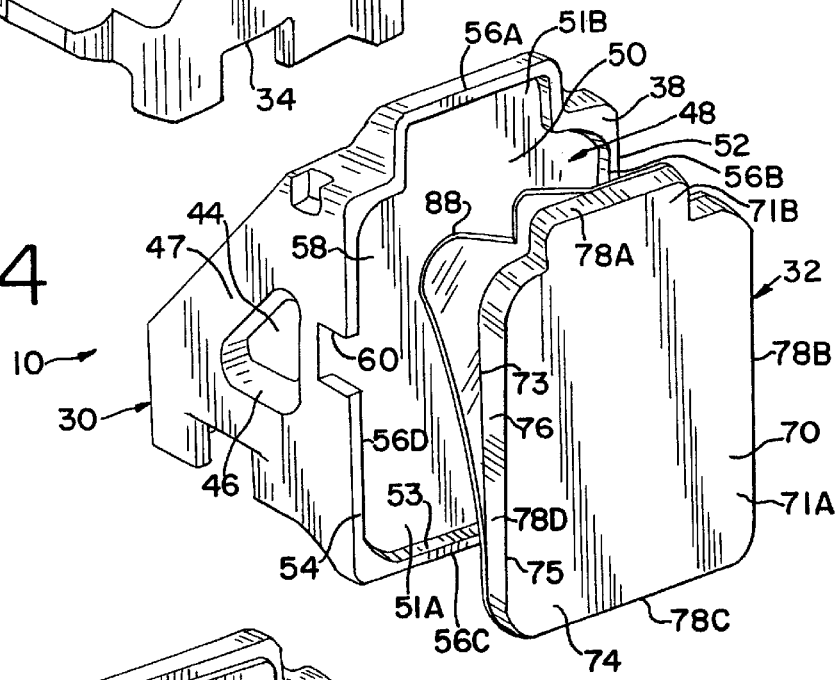
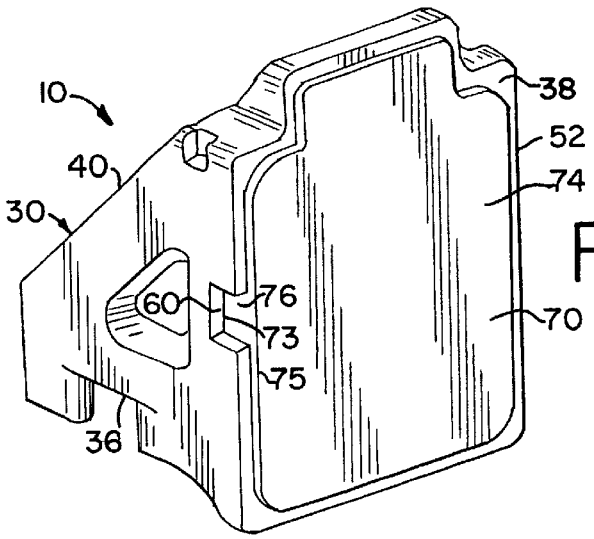
FIG. 5

334
336
338
340
342
344
346
348
350
352
354
356
25

FRICTION WEDGE FOR A RAILROAD CAR TRUCK HAVING A REPLACEABLE WEAR MEMBER

BACKGROUND OF THE INVENTION

The present invention is directed to a friction wedge for a railroad car truck and in particular to a friction wedge including a body having a pocket and a wear member that is adapted to be inserted into the pocket and removably attached to the body such that when the wear member becomes worn it may be removed and replaced with a new wear member.

Railroad car trucks include a pair of spaced apart side frames and a bolster that extends transversely between the side frames. The bolster is resiliently supported at each end on a respective side frame by a plurality of suspension springs. Friction wedges are used in railroad car trucks to dampen movement of the bolster with respect to the side frame of the railroad car truck. Friction wedges are often generally triangular-shaped such that the friction wedge can act as a wedge between an inclined surface of the bolster and a generally vertical wear plate on a column of the side frame. The friction wedge is wedged into engagement between the bolster and the column of the side frame by a suspension spring. Resistance to sliding movement of the friction wedge with respect to the side frame, which in turn provides dampening of bolster movement, is provided by the frictional forces generated between the friction wedge and the wear plate of the side frame column.

Prior art friction wedges sometimes include a wear pad adapted to slidably engage the wear plate of the side frame column such as disclosed in U.S. Pat. No. 2,827,987. A wear pad such as shown in U.S. Pat. No. 2,827,987 is exposed around its edges such that the wear pad is susceptible to being damaged during use after the friction wedge is installed in the railroad car truck, and is susceptible to being damaged during shipment. Such a friction wedge does not include a mechanical structure that prevents lateral sliding movement of the wear pad with respect to the plate member which supports the wear pad. The present invention overcomes these problems in the prior art.

SUMMARY OF THE INVENTION

A friction wedge for a railroad car truck having a bolster, a bolster suspension spring, and a side frame. The friction wedge includes a body having a base adapted to engage the suspension spring, an inclined wall adapted to engage the bolster, and a front face including a pocket. The pocket includes a bottom wall and a peripheral side wall extending outwardly from the bottom wall and substantially around the perimeter of the bottom wall. A wear member is adapted to be located within the pocket of the body. The wear member includes a wear pad having a first wall that is complimentarily-shaped with the bottom wall of the pocket and that is adapted to be placed adjacent to the bottom wall of the pocket. The wear member includes a generally planar second wall spaced apart from the first wall that is adapted to slidably engage the side frame of the railroad car truck. The wear pad includes a peripheral side wall that extends between the first wall and the second wall of the wear pad and that extends around the perimeter of the first and second walls. The first wall of the wear pad extends generally coextensively with the bottom wall of the pocket. The peripheral side wall of the pocket extends around the peripheral side wall of the wear pad and is located closely adjacent to the peripheral side wall of the wear pad. The wear member may include an adhesive layer located on the first wall of the wear pad which is adapted to removably attach the wear pad to the bottom wall of the pocket with a relatively weak adhesive bond such that the wear pad will remain in the pocket during installation of the friction wedge in the railroad car truck while still allowing the wear pad to be selectively removable from the pocket. Alternatively the wear member includes a protrusion adapted to be inserted into a recess in the bottom wall for removably attaching the wear pad to the body of the friction wedge. The peripheral side wall of the pocket prevents any substantial lateral sliding movement of the wear pad with respect to the bottom wall of the pocket. The peripheral side wall of the pocket also covers a substantial portion of the side wall of the wear pad and thereby protects the wear pad from damage.

BRIEF DESCRIPTION OF THE DRAWING FIGURES

FIG. 3 is a rear perspective view of the friction wedge prior to assembly.

FIG. 4 is a front perspective view of the friction wedge prior to assembly.

FIG. 5 is a front perspective view of an assembled friction wedge.

DETAILED DESCRIPTION OF THE PREFERRED EMBODIMENTS

Figure 1:
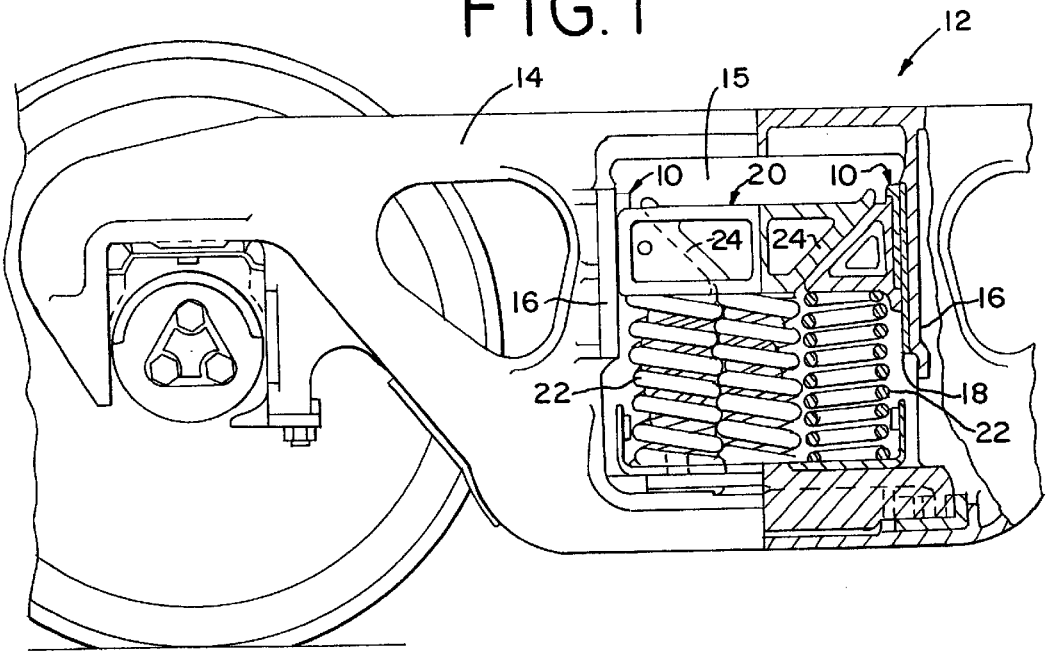
FIG. 1 is a partial cross sectional view showing the friction wedge of the present invention installed in a railroad car truck.

A friction wedge 10 of the present invention is shown in FIG. 1 installed in a railroad car truck 12. The truck 12 includes two side frames 14 (only one shown) which are spaced apart and generally parallel to one another. Each side frame 14 includes a window 15 which forms a pair of spaced apart generally vertical columns 16. A generally planar wear plate 18 is connected to the interior surface of each column 16. The truck 12 also includes a bolster 20 which extends generally transversely between the side frames 14. Each end of the bolster 20 is located within a respective window 15 and is vertically supported on a side frame 14 by a plurality of helical coil suspension springs 22. The suspension springs 22 are resiliently compressible to thereby allow the ends of the bolster 20 to move vertically upwardly and downwardly within the windows 15 and with respect to the side frames 14. The bolster 20 includes a plurality of inclined walls 24. Each inclined wall 24 is adapted to engage a respective friction wedge 10.

Figure 2:
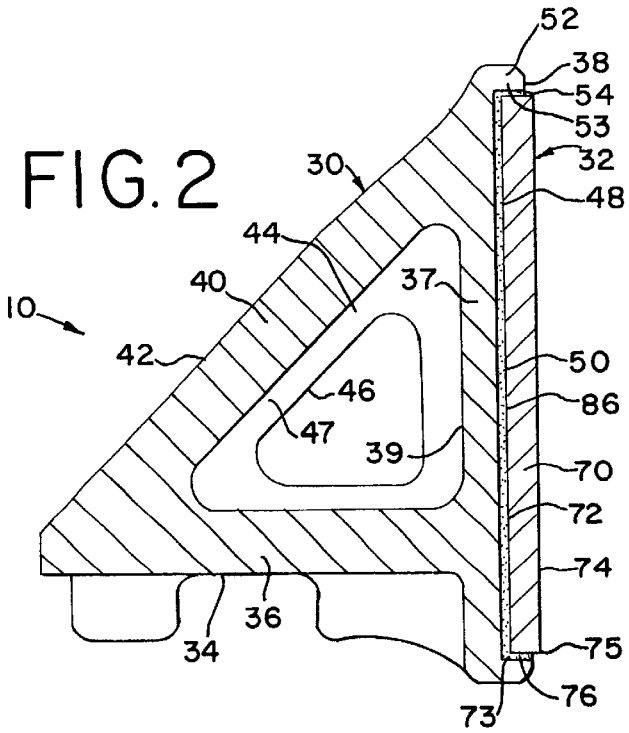
FIG. 2 is a cross sectional view of the friction wedge.

The friction wedge 10 includes a body 30 and a wear member 32. As best shown in FIG. 2, the body 30 is generally triangular or wedge-shaped. The body 30 includes a base 34 having a generally horizontal bottom wall 36. The bottom wall 36 is adapted to engage the top end of a suspension spring 22. The body 30 also includes a generally vertical front wall 37 including a front face 38 and an interior surface 39. The body 30 also includes an inclined wall 40 that extends at an inclined angle of approximately forty-five degrees between the wall 36 of the base 34 and the front face 38. The inclined wall 40 includes a generally planar surface 42 that is adapted to engage an inclined wall 24 of the bolster 20. The body 30 includes a hollow chamber 44 and an aperture 46 in each side wall 47 of the body 30 that is in communication with the chamber 44.

As best shown in FIG. 4, the front face 38 of the front wall 37 includes a pocket 48 that is adapted to receive the wear member 32. The pocket 48 includes a generally planar non-perforate perforate bottom wall 50 and a peripheral side wall 52 that extends substantially around the entire perimeter of the bottom wall 50. The bottom wall 50 includes a generally rectangular first portion 51A at the bottom of the pocket 48 and a smaller generally rectangular second portion 51B at the top of the pocket 48 which extends outwardly from the first portion 51A. The peripheral side wall 52 includes a rim 54 that is located generally coplanar with the front face 38. The peripheral side wall 52 includes an interior surface 53 that extends outwardly from the bottom wall 50 generally transversely thereto to the rim 54. Alternatively, the interior surface 53 may slope outwardly from the bottom wall 50 such that the interior surface 53 is inclined at an obtuse angle to the bottom wall 50. The peripheral side wall 52 includes a plurality of side wall segments 56A–D. The side wall segment 56A is generally horizontal and is located adjacent the top end of the front face 38. The side wall segment 56C is generally horizontal and is located at the bottom end of the front face 38 and is spaced apart from and generally parallel to the side wall segment 56A. The side wall segment 56B is located at a first side of the front face 38 and extends generally vertically between the side wall segments 56A and 56C. The side wall segment 56D is located at a second side of the front face 38 and extends generally vertically between the side wall segments 56A and 56C. The pocket 48 includes a cavity 58 formed by the bottom wall 50 and the peripheral side wall 52. The body 30 of the friction wedge 10 may be made from metals such as steel or iron, or from plastic or composite materials.

If desired, the peripheral side wall 52 of the pocket 48 may include a notch 60 which extends from the rim 54 of the side wall 52 to the bottom wall 50. The notch 60 provides an opening through the side wall 52 and thereby access to the cavity 58 from the exterior of the side wall 52. The notch 60 is shown located in the side wall segment 56D in FIG. 4, but may be located in any of the other side wall segments 56A–C if desired. More than one notch 60 may be formed in the side wall 52 if desired, such as in each of the side wall segments 56B and 56D.

The wear member 32 includes a wear element or pad 70. The wear pad 70 includes a lower generally rectangular first portion 71A and a smaller upper generally rectangular second portion 71B extending upwardly from the first portion 71A. The wear pad 70 includes a generally planar first wall 72 having a peripheral edge 73, and a generally planar second wall 74 spaced apart from and generally parallel to the first wall 72 having a peripheral edge 75. A peripheral side wall 76 extends between the peripheral edge 73 of the first wall 72 and the peripheral edge 75 of the second wall 74 and extends around the perimeter of the first and second walls 72 and 74. The peripheral side wall 76 may be generally perpendicular to the second wall 74, or may be disposed at an acute angle to the second wall 74, as may be required such that the side wall 76 will be generally parallel to the interior surface 53 of the peripheral side wall 52. The peripheral side wall 76 includes a plurality of generally linear side wall segments 78A–D. As shown in FIG. 4, the wear pad 70 is generally plate-like. The wear pad 70 may be made from metals such as steel or iron, or from plastic, ceramic or composite wear-resistant materials.

As best shown in FIGS. 2 and 3, the wear member 32 includes a connector member such as a layer of adhesive 86 coated on the first wall 72 of the wear pad 70. The adhesive layer 86 is coated generally uniformly over the entire area of the first wall 72 of the wear pad 70, but the adhesive layer 86 may be applied to the first wall 72 as one or more patches which do not completely cover the first wall 72. The adhesive layer 86 is adapted to removably attach the first wall 72 of the wear pad 70 to the bottom wall 50 of the pocket 48 and thereby to the front face 38 of the front wall 37 with a relatively weak adhesive bond. The adhesive layer 86 is adapted to retain the wear pad 70 within the pocket 48 of the body 30 during installation of the friction wedge 10 in the railroad car truck 12, but to allow the wear pad 70 to be easily removed from the pocket 48 when desired. As an alternative to use of the adhesive layer 86, various other types of connector members including mechanical fasteners, such as cable ties, cotter pins or clinch pins, may be used to removably retain the wear pad 70 within the pocket 48 prior to installation.

The wear member 32 may also include a protective sheet liner 88 which is removably attached to the adhesive layer 86 and which covers the entire adhesive layer 86 to prevent foreign objects from becoming inadvertently adhered to the adhesive layer 86. The liner 88 may include a wax or wax-like coating to provide for the removable attachment of the liner 88 to the adhesive layer 86. The liner 88 may be peelably removed from the adhesive layer 86 and the wear pad 70, without any portion of the liner 88 remaining adhered to the adhesive layer 86, to expose the adhesive layer 86 prior to insertion of the wear member 32 into the pocket 48.

When the wear pad 70 is inserted into the pocket 48 of the body 30, the first wall 72 is located adjacent and parallel to the bottom wall 50 of the pocket 48. The first wall 72 extends substantially coextensively with the bottom wall 50. The peripheral side wall 52 of the pocket 48 extends around the peripheral side wall 76 of the wear pad 70 and is located closely adjacent to the peripheral side wall 76 of the wear pad 70 along its entire length. The interior surface 53 of the peripheral side wall 52 is located generally parallel to the side wall 76 of the wear pad 70. The side wall segment 56A is thereby located closely adjacent to the side wall segment 78A, the side wall segment 56B is located closely adjacent to the side wall segment 78B, the side wall segment 56C is located closely adjacent to the side wall segment 78C, and the side wall segment 56D is located closely adjacent to the side wall segment 78D. The peripheral side wall 52 of the pocket 48 is adapted to abut the wear pad 70 to substantially prevent lateral sliding movement of the wear pad 70 with respect to the bottom wall 50 of the pocket 48 and the front face 38 in any direction generally parallel to the second wall 74 and front face 38.

As best shown in FIG. 2, when the wear pad 70 is located within the pocket 48 of the body 30, the second wall 74 of the wear pad 70 is located outside of the pocket 48 and outwardly beyond the front face 38 of the front wall 37. Alternatively, the second wall 74 may be located generally coplanar with the front face 38 such that the wear pad 70 and the front face 38 will both slidably engage the wear plate 18.

In operation, the friction wedge 10 is assembled by initially removing the liner 88 of the wear member 32 from the adhesive layer 86. The wear member 32 is then inserted into the pocket 48 such that the first wall 72 of the wear pad 70 is located adjacent to and parallel with the bottom wall 50 of the pocket 48 and such that the adhesive layer 86 attaches the first wall 72 of the wear pad 70 to the bottom wall 50 of the body 30. The adhesive layer 86 removably attaches the wear pad 70 to the bottom wall 50 of the body 30 such that the wear pad 70 will not inadvertently fall out of the pocket 48 while the friction wedge 10 is being handled during installation or removal from the truck 12.

The friction wedge 10 is adapted to be installed in a railroad car truck 12 as shown in FIG. 1 such that a suspension spring 22 engages the wall 36 of the base 34, and such that the inclined wall 24 of the bolster 20 engages the surface 42 of the inclined wall 40 of the body 30. The spring 22 and the inclined wall 24 of the bolster 20 thereby force the second wall 74 of the wear pad 70 into abutting engagement with the wear plate 18 on the column 16 of the side frame 14. The wear pad 70 of the friction wedge 10 slides generally upwardly and downwardly in engagement with the wear plate 18 conjointly with and in response to upward and/or downward movement of the bolster 20 within the window 15. The frictional force generated between the wear pad 70 and the wear plate 18 dampens the movement of the bolster 20 within the window 15 relative to the side frame 14.

Due to the frictional sliding engagement between the wear pad 70 and the wear plate 18, the wear pad 70 becomes worn over time. When the friction wedge 10 requires maintenance or refurbishing, the friction wedge 10 is removed from the truck 12. The tip of a screwdriver, or other implement, can be inserted through the notch 60 into engagement with the peripheral edge 73 of the first wall 72 of the wear pad 70. The wear pad 70 may thereby be pried loose from the bottom wall 50 of the pocket 48 by breaking the relatively weak adhesive bond therebetween that is provided by the adhesive layer 86. A new replacement wear pad 70 may then be inserted into the pocket 48 in the same manner as the original wear pad 70 was inserted. The refurbished friction wedge 10 may then be reinstalled in the truck 12. The reinstalled friction wedge 10 includes a new wear pad 70, but includes the original body 30. The reuse of the original body 30 improves performance of the truck 12 over the performance that would be provided using a new body 30 as the original body 30 is already broken-in for use with the truck 12.

The peripheral side wall 52 of the pocket 48 extends substantially around the peripheral side wall 76 of the wear pad 70 and substantially covers the peripheral side wall 76 of the wear pad 70. The peripheral side wall 52 of the pocket 48 thereby protects the wear pad 70 from being damaged after installation and during use by any foreign objects, such as stones, that may otherwise strike and damage the wear pad 70. The two-part assembly of the friction wedge 10 also allows the wear pad 70 to be packaged and shipped separately from the relatively heavy body 30 to prevent damage of the wear pad 70 during shipment. Various different types of wear pads 70, as for example made from different types of materials, may be exchanged for one another and used within the pocket 48 of the body 30 of a friction wedge 10 to thereby modify the particular damping characteristics provided by the friction wedge 10.

Figure 7:
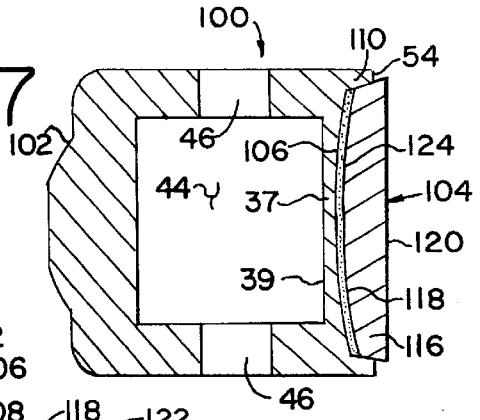
FIG. 7 is a cross sectional view of an assembled friction wedge taken along line 7—7 of FIG. 6.
Figure 6:
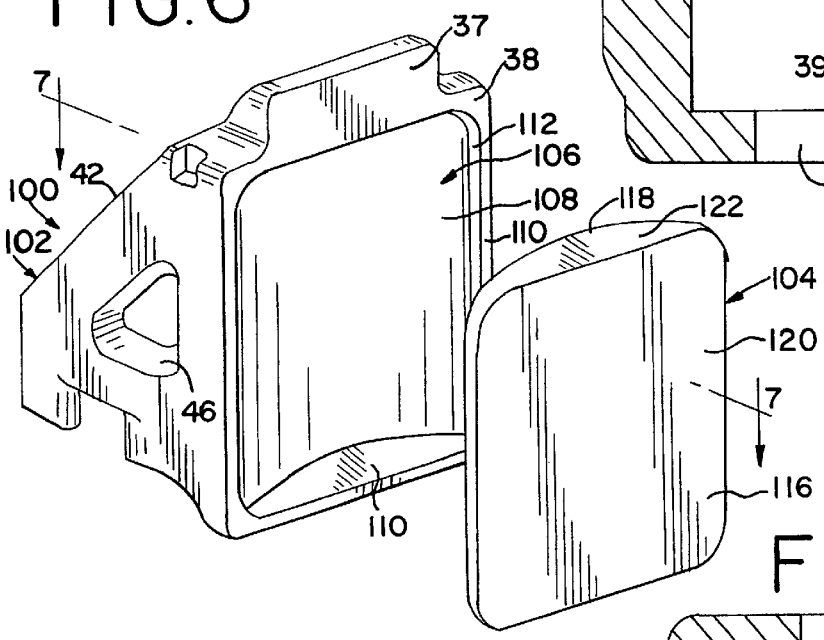
FIG. 6 is a front perspective view of a modified embodiment of the friction wedge wherein the pocket includes a concavely curved bottom wall and the wear pad includes a convexly curved first wall.

A modified embodiment of the friction wedge of the present invention is shown in FIGS. 6 and 7 and is identified with the reference number 100. Like reference numbers are used to indicate like elements between the various embodiments of the friction wedge. The friction wedge 100 includes a body 102 and a selectively removable wear member 104. The front face 38 of the body 102 includes a pocket 106 including a bottom wall 108 and a peripheral side wall 110. The bottom wall 108 is at least partially nonplanar, and is preferably generally concavely curved in a generally cylindrical manner about a vertical axis. The bottom wall 108 may alternatively be concavely curved in a generally cylindrical manner about a horizontal axis, may be concavely curved in a generally spherical manner, or may be corrugated-shaped. The peripheral side wall 110 includes an interior surface 112. The interior surface 112 is sloped outwardly as it extends from the bottom wall 108 to the peripheral rim 54 of the side wall 110.

The wear member 104 includes a wear pad 116 having a first wall 118 and a second wall 120 spaced apart from the first wall 118. The first wall 118 is at least partially nonplanar and is complimentarily-shaped to matingly conform to the bottom wall 106. The first wall 118 as shown in FIGS. 6 and 7 is generally convexly curved in a generally cylindrical manner and is adapted to matingly conform to the concavely curved bottom wall 108 of the pocket 106. The second wall 120 of the wear pad 116 is generally planar. A peripheral side wall 122 extends between the first wall 118 and the second wall 120. The peripheral side wall 122 slopes inwardly as it extends from the second wall 120 to the first wall 118. The peripheral side wall 122 is disposed at an acute angle to the second wall 120 and is adapted to be located generally parallel to the interior surface 112 of the peripheral side wall 110 of the pocket 106. The wear member 104 includes a connector member such as an adhesive layer 124 located on the first wall 118 of the wear pad 116 which is adapted to removably attach the first wall 118 of the wear pad 116 to the bottom wall 108 of the pocket 106. The wear pad 116 may also include a selectively removable liner, such as the liner 88, which covers the adhesive layer 124 until the wear pad 116 is to be inserted into the pocket 106. The curved first wall 118 of the wear pad 116 maximizes the strength of the wear pad 116 and provides increased engagement between the wear pad 116 and the body 102 to prevent relative movement therebetween. The sloped interior surface 112 of the peripheral side wall 110 and the mating sloped peripheral side wall 122 of the wear pad 116 provide a tight fit therebetween to also limit the amount of relative movement between the wear pad 116 and the body 102.

Figure 9:
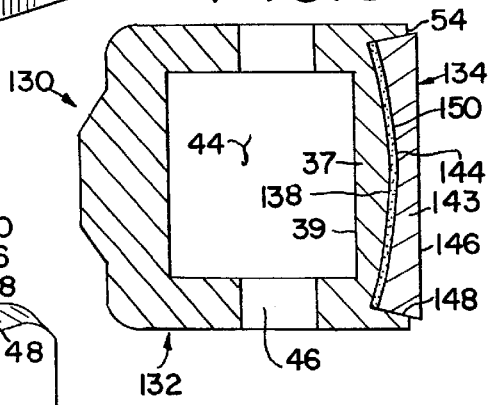
FIG. 9 is a cross sectional view of an assembled friction wedge taken along line 9—9 of FIG. 8.
Figure 8:
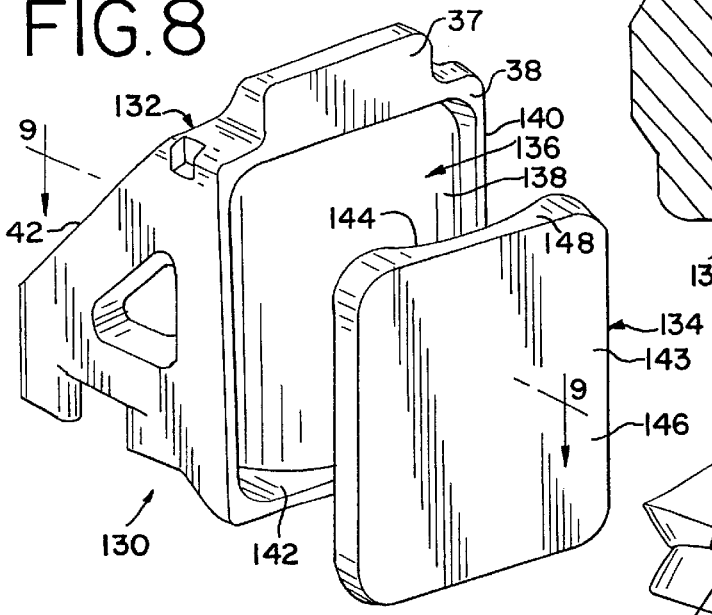
FIG. 8 is a front perspective view of another modified embodiment of the friction wedge wherein he bottom wall of the pocket is convexly curved and the first wall of the wear pad is convexly curved.

Another modified embodiment of the friction wedge of the present invention is shown in FIGS. 8 and 9 and is identified with the reference number 130. The friction wedge 130 includes a body 132 and a selectively removable wear member 134. The body 132 includes a pocket 136 having a bottom wall 138 and a peripheral side wall 140. The bottom wall 138 is generally convexly curved in a generally cylindrical manner about a generally vertical axis. However, if desired the bottom wall 138 may be convexly curved in a generally cylindrical manner about a generally horizontal axis. The bottom wall 138 may also be generally convexly curved in a spherical manner. The peripheral side wall 140 includes an interior surface 142 that is sloped outwardly.

The wear member 134 includes a wear pad 143 having a first wall 144 and a spaced apart second wall 146. The first wall 144 is complimentarily-shaped to the bottom wall 138 and is generally concavely curved in a generally cylindrical manner such that the first wall 144 is adapted to matingly conform to the convexly curved bottom wall 138. If the bottom wall 138 is convexly spherically curved, the first wall 144 would also be generally concavely spherically curved to matingly conform to the bottom wall 138. The second wall 146 is generally planar. A peripheral side wall 148 extends between the first wall 144 and the second wall 146. The peripheral side wall 148 is sloped inwardly such that the peripheral side wall 148 is adapted to matingly engage the interior surface 142 of the peripheral side wall 140 of the pocket 136. A connector member such as an adhesive layer 150 is located on the first wall 144 of the wear pad 143. The adhesive layer 150 is adapted to removably attach the first wall 144 of the wear pad 143 to the bottom wall 138 of the pocket 136. The curved surfaces of the bottom wall 138 of the pocket 136 and of the first wall 144 of the wear pad 143 provide increased resistance to relative movement between the wear member 134 and the body 132.

Figure 11:
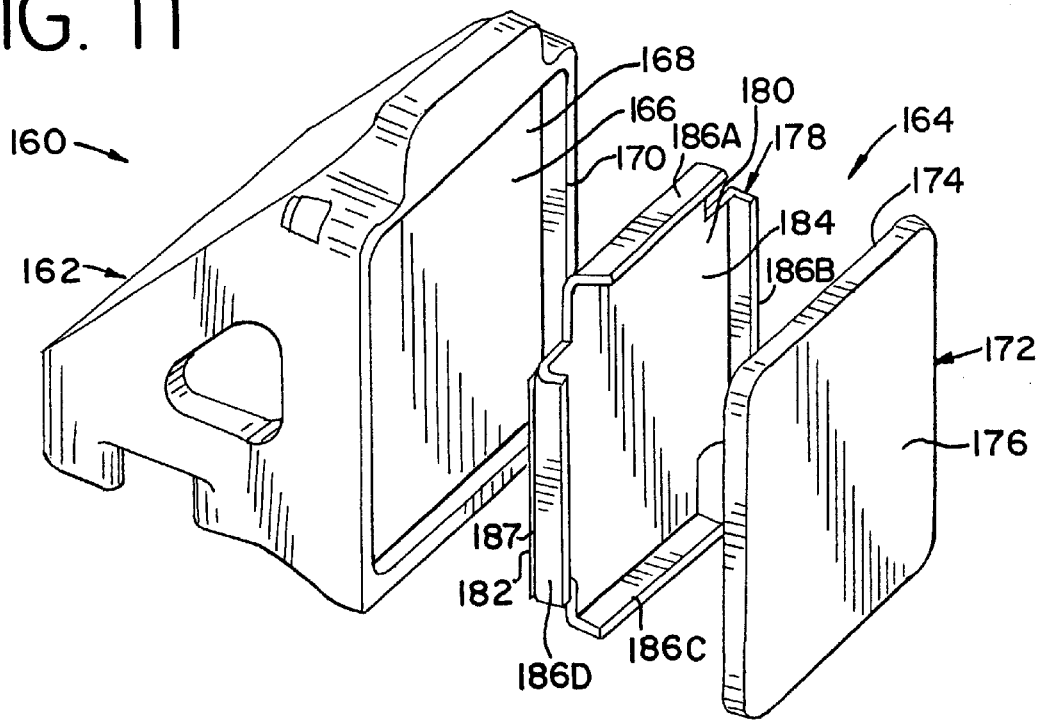
FIG. 11 is a front perspective view of a further modified embodiment of the friction wedge prior to assembly.

FIG. 11 shows a further modified embodiment of the friction wedge of the present invention identified with the reference number 160. The friction wedge 160 includes a body 162 and a removable wear member 164. The body 162 includes a generally rectangular pocket 166 having a generally planar and rectangular bottom wall 168 and a peripheral side wall 170.

The wear member 164 includes a wear pad 172 having a generally planar first wall 174 and a spaced apart and generally parallel planar second wall 176. The wear member 164 also includes a backing member 178 that may be made from metal, plastic or other substantially rigid materials. The backing member 178 includes a generally planar plate 180 having an outer surface 182 and an interior surface 184. The backing member 178 also includes a plurality of tabs 186A–D attached to and around the peripheral edge of the plate 180. The tabs 186A–D extend outwardly from the plate 180 and generally transversely thereto. The first wall 174 of the wear pad 172 may be permanently bonded to the interior surface 184 of the backing member 178 or removably adhered thereto by a layer of adhesive applied to the first wall 174 of the wear pad 172. The tabs 186A–D protect the peripheral side wall of the wear pad 172 from damage.

A connector member such as a layer of adhesive 187 may be located on the outer surface 182 of the plate 180. A removable liner may be applied to the adhesive layer if desired. After the liner is removed, the wear member 164 is inserted into the pocket 166 of the body 162 such that the adhesive layer on the backing member 178 attaches the plate 180 to the bottom wall 168 of the body 162. The plate 180 of the backing member 178 prevents wear of the first wall 174 of the wear pad 172 and provides a rigid planar surface to support the wear pad 172 in the event the bottom wall 168 of the pocket 166 is not perfectly planar or if it contains surface irregularities. The tabs 186A–D of the backing member 178 may alternatively releasably interlock with the peripheral side wall 170 to removably attach the wear member 164 to the body 162 without the use of the adhesive layer 187 between the backing member 178 and the bottom wall 168 of the pocket 166.

Figure 12:
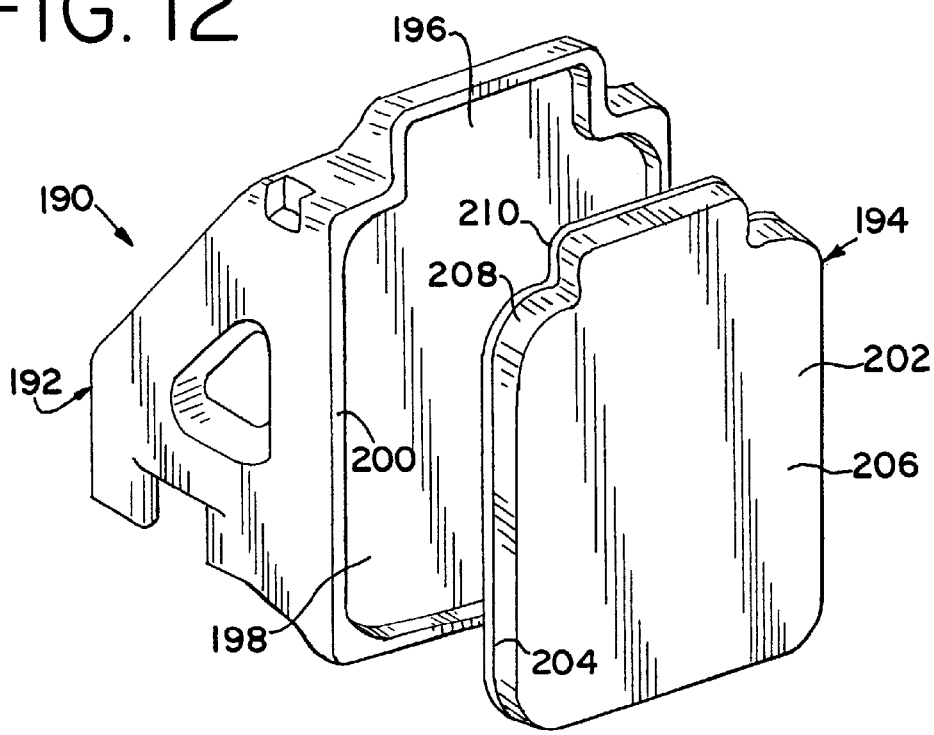
FIG. 12 is a front perspective view of a further modified embodiment of the friction wedge prior to assembly.

FIG. 12 is a further modified embodiment of the friction wedge of the present invention identified with the reference number 190. The friction wedge 190 includes a body 192 and a wear member 194. The body 192 includes a pocket 196 having a bottom wall 198 and a peripheral side wall 200. The wear member 194 includes a wear pad 202 including a generally planar first wall 204 and a spaced apart and generally parallel planar second wall 206. The wear member 194 also includes a backing member 208 that comprises a generally planar plate. The backing member 208 includes an interior surface which is attached to the first wall 204 of the wear pad 202 and which extends coextensively with the first wall 204. A connector member such as a layer of adhesive 210 is located on the exterior surface of the backing member 208. If desired a removable liner may be applied to the adhesive layer 210. The adhesive layer 210 is adapted to removably attach the backing member 208 to the bottom wall 198 of the pocket 196. The backing member 208 protects the first wall 204 of the wear pad 202 from any surface irregularities in the bottom wall 198 of the pocket 196. The backing member 208 is made from metal, plastic or other generally rigid materials.

Figure 13:
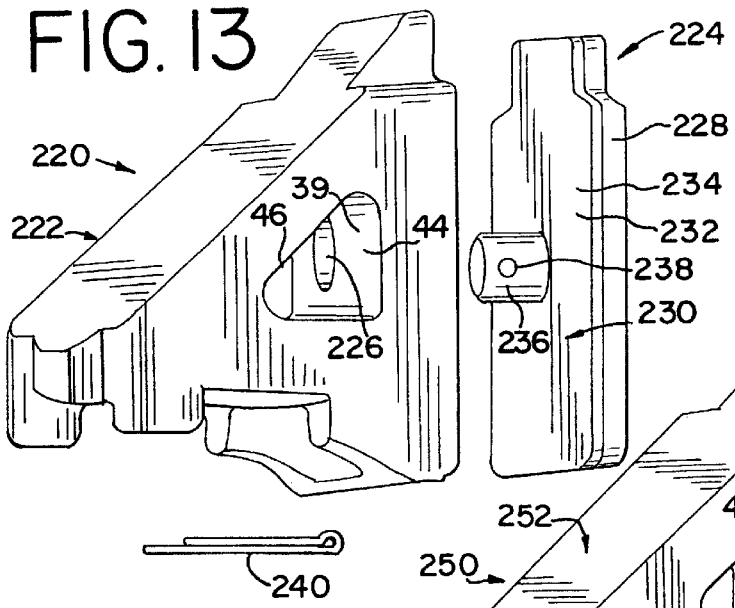
FIG. 13 is a rear perspective view of a further modified embodiment of the friction wedge prior to assembly.

Another modified embodiment of the friction wedge of the present invention is shown in FIG. 13 and is identified with the reference number 220. The friction wedge 220 includes a body 222 and a removable wear member 224. The body 222 is substantially identical to the body 30 as shown in FIG. 4 except that the body 222 includes a recess 226 formed in the bottom wall 50 of the pocket 48. As shown in FIG. 13, the recess 226 comprises a bore which extends through the front wall 37 from the bottom wall 50 to the interior surface 39 of the wall 37 such that the recess 226 is in communication with the chamber 44 within the body 222.

The wear member 224 includes a wear pad 228 and a backing member 230. The backing member 230 includes a generally planar backing plate 232 having an interior surface attached to the wear pad 228 and an exterior surface 234. The backing member 230 includes a connector member such as a protrusion 236 that is attached to the exterior surface 234 of the backing plate 232 and which extends outwardly generally transversely from the plate 232. The protrusion 236 includes a bore 238 extending generally transversely therethrough and generally parallel to the backing plate 232.

The protrusion 236 is adapted to extend through the recess 226 in the body 222, when the wear member 224 is inserted into the pocket of the body 222, such that the bore 238 in the protrusion 236 is located within the chamber 44 of the body 222. A fastener 240 such as a pin, cotter pin or clinch pin, may then be inserted through the bore 238 and which will prevent withdrawal of the protrusion 236 from the recess 226. The protrusion 236 and the fastener 240 thereby removably attach the wear member 224 to the body 222 within the pocket 48. The protrusion 236 also laterally interlocks with the bottom wall 50 of the pocket 48 to assist in preventing lateral movement of the wear pad 228 with respect to the bottom wall 50.

Figure 14:
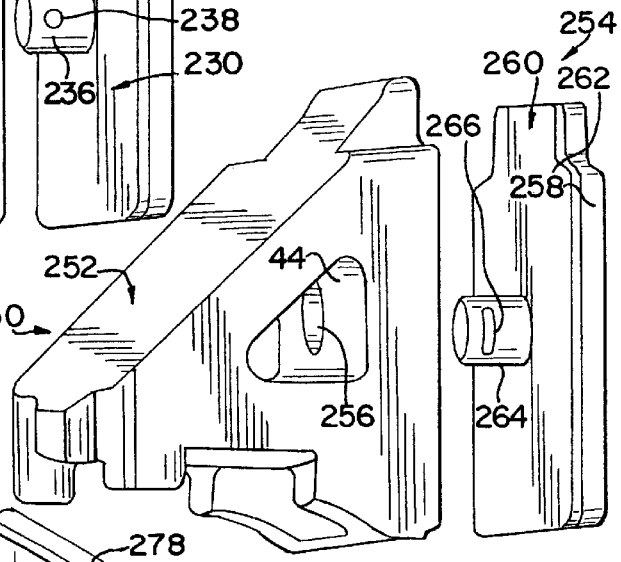
FIG. 14 is a rear perspective view of another modified embodiment of the friction wedge prior assembly.

FIG. 14 shows another embodiment of the friction wedge of the present invention identified with the reference number 250. The friction wedge 250 includes a body 252 and a wear member 254. The body 252 is constructed substantially identical to the body 222 as shown in FIG. 13 and includes a recess 256 which is substantially identical to the recess 226. The wear member 254 includes a wear pad 258 and a backing member 260. The backing member 260 includes a backing plate 262 that is attached to the wear pad 258 and a connector member such as a protrusion 264 that extends outwardly and generally perpendicular from the backing plate 262. The protrusion 264 includes a pair of generally elongate grooves 266 disposed on opposite sides of the protrusion 264. The grooves 266 extend generally parallel to the backing plate 262. When the wear member 254 is inserted into the pocket of the body 252, the protrusion 264 extends through the recess 256 such that the grooves 266 are located within the chamber 44 of the body 252. A fastener 268 such as a retainer ring may then be removably connected to the protrusion 264 by insertion into the grooves 266. The fastener 268 and the protrusion 264 thereby removably attach the wear member 254 to the body 252.

Figure 15:
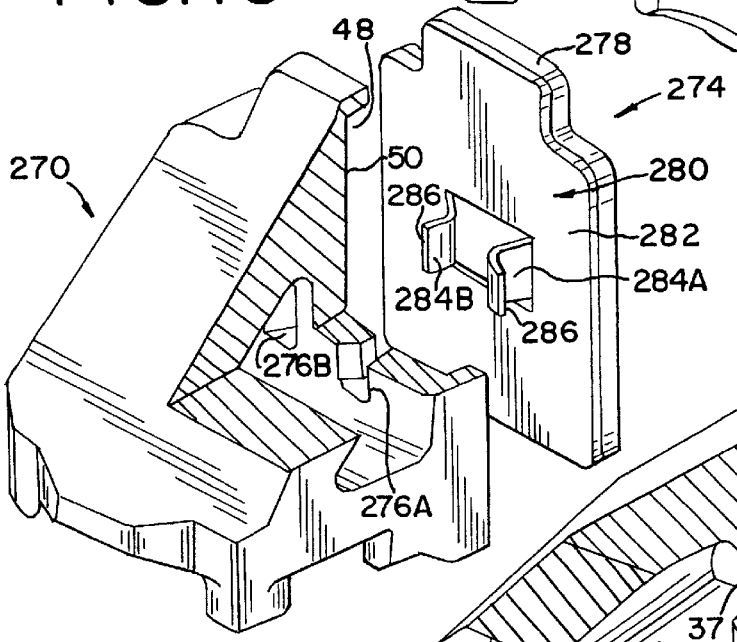
FIG. 15 is a cut-away rear perspective view of a further modified embodiment of the friction wedge prior to assembly.
Figure 15:
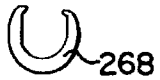
Figure 16:
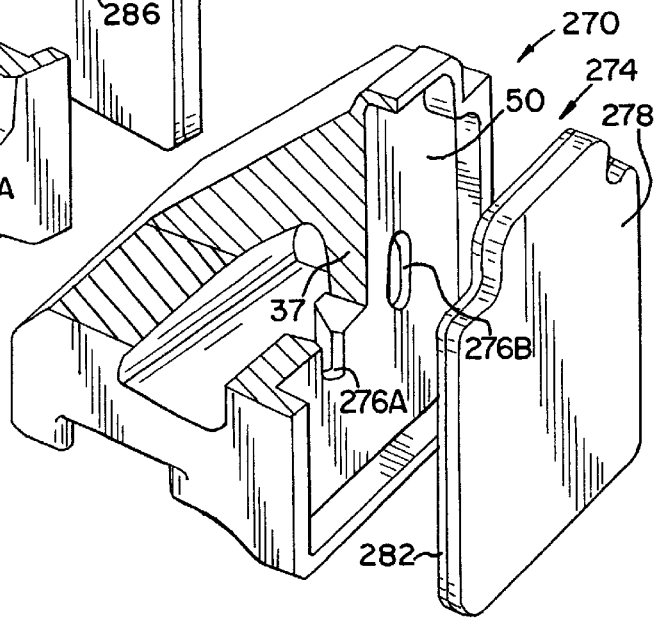
FIG. 16 is a cut-away front perspective view of the friction wedge of FIG. 15 prior to assembly.

Another embodiment of the friction wedge of the present invention is shown in FIGS. 15 and 16 and is identified with the reference number 270. The friction wedge 270 includes a body 272 and a wear member 274. The body 272 is substantially similar to the body 30 as shown in FIG. 4 except that the body 272 includes recesses 276A–B formed in the bottom wall 50 of the pocket 48. The recesses 276A–B may be formed as apertures which extend entirely through the front wall 37 as shown in FIGS. 15 and 16, or as pockets which extend only partially into the front wall 37.

The wear member 274 includes a wear pad 278 and a backing member 280. The backing member 280 includes a backing plate 282 having an interior surface which is attached to the wear pad 278. The backing member 280 also includes a connector member such as resilient clip members 284A–B. Each clip member 284A–B is attached at its base to the backing plate 282 and includes a tip 286. The clip members 284A–B are resiliently flexible.

When the wear member 274 is inserted into the pocket 48 of the body 272, the clip member 284A is inserted into the recess 276A and the clip member 284B is inserted into the recess 276B. The clip members 284A–B are resiliently biased such that the tips 286 engage and releasably grip the interior surface of the recesses 276A–B. The clip members 284A–B thereby removably attach the wear member 274 to the body 272 while allowing the wear member 274 to be selectively removed from the body 272. The backing member 280 may be made from metal, plastic or other generally rigid materials.

A further embodiment of the friction wedge of the present invention is shown in FIGS. 17–25 and is identified with the reference number 310. The friction wedge 310 includes a body 312 and a selectively removable wear member 314. The body 312 includes a front wall 316 having a pocket 318. The pocket 318 includes a bottom wall 320 and a peripheral side wall 322 that extends substantially around the perimeter of the bottom wall 320. The side wall 322 may include one or more notches 60 if desired. The bottom wall 320 of the pocket 318 is at least partially non-planar, and is preferably convexly-concavely curved. The convexly-concavely curved bottom wall 320 includes a generally concavely curved upper surface portion 324. The convexly-concavely curved bottom wall 320 also includes a generally convexly curved lower surface portion 326. The peripheral side wall 322 includes an interior surface 328 which is sloped outwardly as it extends from the bottom wall 320 to the outer peripheral rim of the side wall 322.

The wear member 314 includes a wear pad 334 having a first wall 336 and a second wall 338 spaced apart from the first wall 336. A peripheral side wall 340 extends between the edges of the first wall 336 and the second wall 338. The side wall 340 slopes inwardly as it extends from the second wall 338 to the first wall 336. The peripheral side wall 340 is disposed at an acute angle to the second wall 338 and is adapted to be located generally parallel to the interior surface 328 of the peripheral side wall 322 of the pocket 318. The second wall 338 of the wear pad 334 is generally planar and forms an engagement surface adapted to slidably engage the wear plate 18 of the side frame 14.

The first wall 336 of the wear pad 334 is at least partially non-planar and is complimentarily-shaped with the bottom wall 320 of the pocket 318 such that the first wall 336 matingly conforms to the bottom wall 320 of the pocket 318. The first wall 336 as best shown in FIGS. 20–25 is generally convexly-concavely curved and is shaped substantially identically to the shape of the bottom wall 320 of the pocket 318, but rotated 180°. The convexly-concavely curved first wall 336 includes a generally convexly curved upper surface portion 342. The convexly-concavely curved first wall 336 also includes a generally concavely curved lower surface portion 344. The convexly curved upper surface portion 342 of the first wall 336 is adapted to matingly fit within the concavely curved upper surface portion 324 of the bottom wall 320 of the pocket 318. The concavely curved lower surface portion 344 of the first wall 336 is adapted to matingly receive the convexly curved lower surface portion 326 of the bottom wall 320 of the pocket 318. The first wall 336 of the wear pad 334 includes a top edge 346 that is generally convexly curved, an opposing bottom edge 348 that is generally concavely curved, and a generally linear left edge 350 and a generally linear right edge 352 which extend generally parallel to one another between the top edge 346 and the bottom edge 348.

Figures 20, 21, 22, 23, 24, 25:
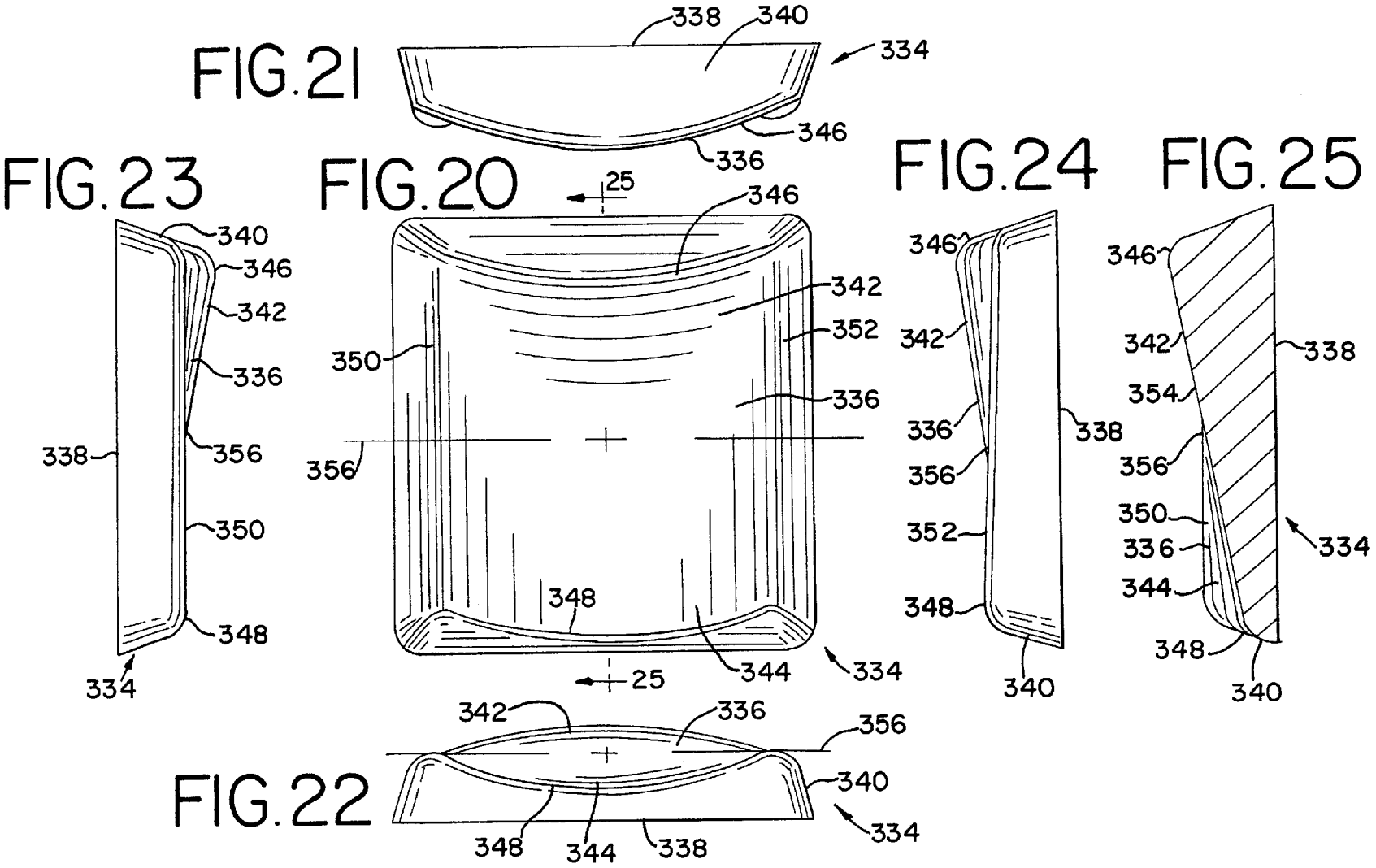
FIG. 20 is a rear elevational view of the wear pad as shown in FIG. 17.
FIG. 21 is a top plan view of the wear pad of FIG. 20.
FIG. 22 is a bottom view of the wear pad of FIG. 20.
FIG. 23 is a left side elevational view of the wear pad of FIG. 20.
FIG. 24 is a right side elevational view of the wear pad of FIG. 20.
FIG. 25 is a cross sectional view taken along line 25—25 of FIG. 20.

As best shown in FIG. 25, the convexly-concavely curved first wall 336 includes a plurality of generally linear lines 354 that extend from adjacent the bottom edge 348 to adjacent the top edge 346 of the first wall 336. Each line 354 includes a midpoint located on the generally horizontal linear axis 356. The line 354 at the left edge 350 is generally parallel to the second wall 338. Each line 354, as the lines 354 are located adjacent to one another from the left edge 350 to the vertical center line of the first wall 336 located at the section line 25—25, is rotated about the linear axis 356 in a counter-clockwise direction as viewed from the right as shown in FIGS. 24 and 25 at a slightly larger angle than the previously adjacent line 354. The line 354 located at the section line 25—25 as shown in FIG. 25 extends generally linearly between the highest point on the convexly curved top edge 346 and the lowest point on the concavely curved bottom edge 348. As the lines 354 are located adjacent to one another from the vertical center line of the first wall 336 to the right edge 352, each line 354 is rotated about the linear axis 356 in a clockwise direction as viewed from the right as shown in FIGS. 24 and 25 at a slightly larger angle than the previously adjacent line 354. The line 354 at the right edge 352 is generally parallel to the second wall 338. The front wall 336 is generally symmetrical about the vertical center line at section line 25—25. The convexly-concavely curved bottom wall 320 of the pocket 318 is shaped in the same manner as the first wall 336 but is rotated 180°.

The wear member 314 also includes a connector member such as an adhesive layer 360 located on the first wall 336 of the wear pad 334 which is adapted to removably attach the first wall 336 of the wear pad 334 to the bottom wall 320 of the pocket 318 and thereby to the front wall 316 of the body 312. The wear member 314 may also include a selectively removable liner, such as the liner 88, which covers the adhesive layer 360 until the wear pad 334 is to be inserted into the pocket 318.

When the wear pad 334 is located within the pocket 318 of the body 312, the convexly-concavely curved first wall 336 of the wear pad 334 mates with the convexly-concavely curved bottom wall 320 of the pocket 318, such that the convexly curved upper surface portion 342 of the first wall 336 mates and interlocks with the concavely curved upper surface portion 324 of the bottom wall 320 and such that the concavely curved lower surface portion 344 of the first wall 336 mates and interlocks with the convexly curved lower surface portion 326 of the bottom wall 320. The interlocking of these curved surface portions provides increased engagement between the first wall 336 of the wear pad 334 and the bottom wall 320 of the pocket 318 and substantially prevents any relative lateral movement between the wear pad 334 and the bottom wall 320 in a direction generally parallel to the second wall 338 of the wear pad 334. The sloped interior surface 328 of the pocket 318 and the mating sloped peripheral side wall 340 of the wear pad 334 provide a tight fit therebetween to also substantially prevent relative lateral movement between the wear pad 334 and the bottom wall 320 of the pocket 318.

Figure 10:
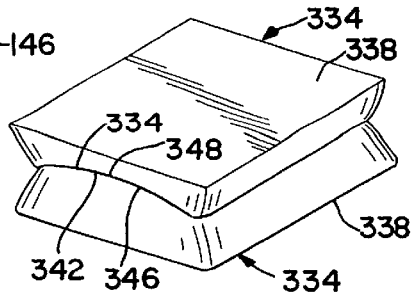
FIG. 10 is a perspective view of a first wear pad including a convexly-concavely curved first wall as shown in FIG. 20 engaging a second wear pad including a convexly-concavely curved side wall as shown in FIG. 20 interlocked with one another for shipment.
Figure 17:
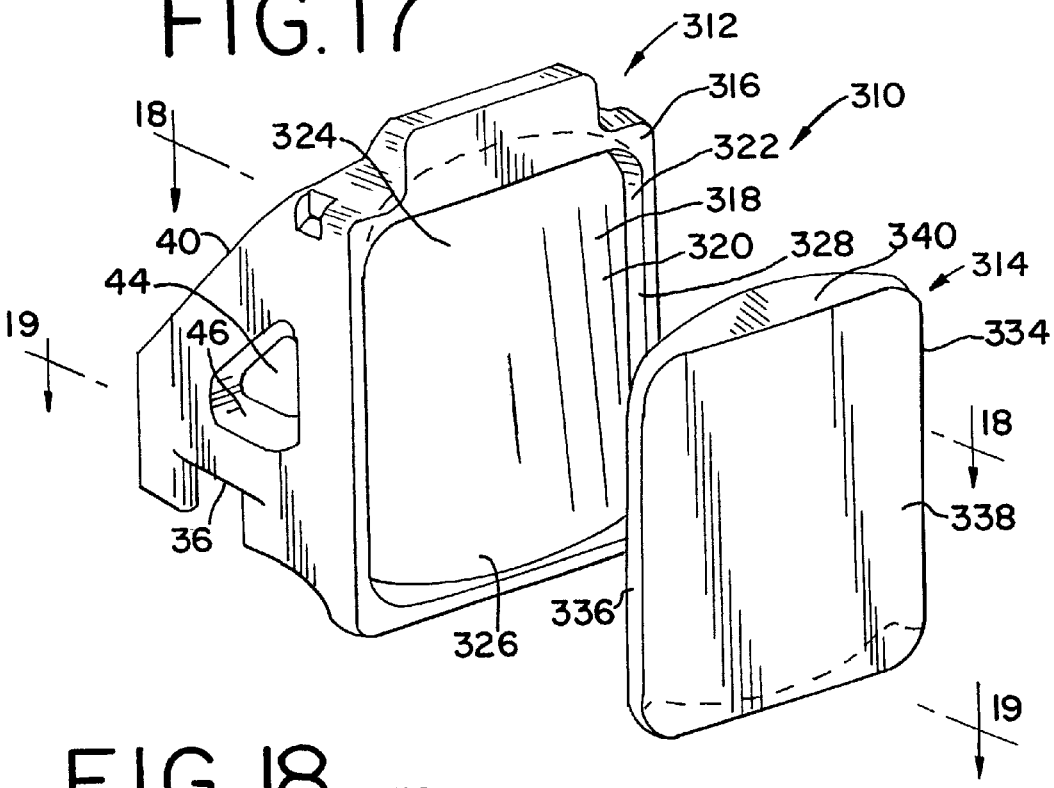
FIG. 17 is a front perspective view of another embodiment of the friction wedge shown prior to assembly.
Figure 18:
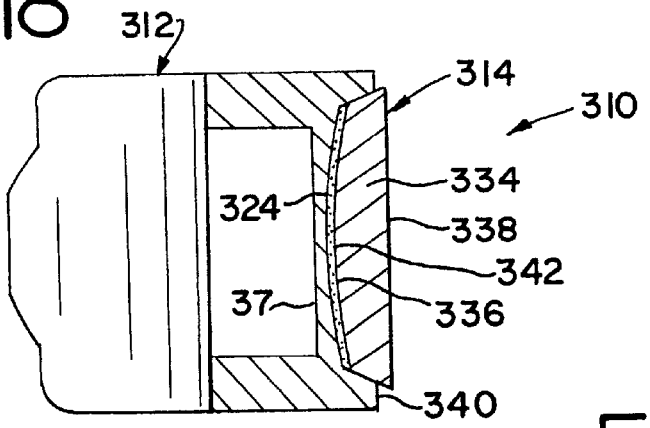
FIG. 18 is a cross sectional view of the assembled friction wedge of FIG. 17 taken along line 18—18 of FIG. 17.
Figure 19:
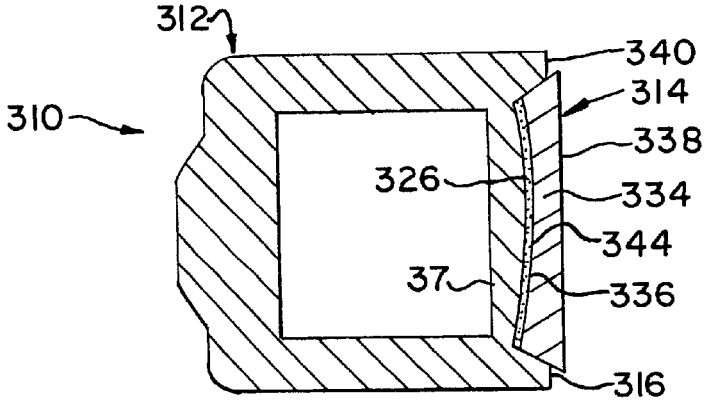
FIG. 19 is a cross sectional view of the assembled friction wedge of FIG. 17 taken along line 19—19 of FIG. 17.

The railroad car truck 12 includes a plurality of friction wedges 310 as shown in FIGS. 17–19. Thus when the wear pads 334 of these friction wedges are due to be replaced, new wear members 314 will be required. As shown in FIG. 10, the convexly-concavely curved first wall 336 of a first wear pad 334 is adapted to matingly conform to the convexly-concavely curved first wall 336 of a second wear pad 334 that is rotated 180° with respect to the first wear pad to thereby allow the two wear pads to interlock with one another during shipment.

Various features of the invention have been particularly shown and described in connection with the illustrated embodiments of the invention, however, it must be understood that these particular arrangements merely illustrate, and that the invention is to be given its fullest interpretation within the terms of the appended claims.

What is claimed is:

1. A friction wedge for a railroad car truck having a bolster, a suspension spring, and a side frame, said friction wedge comprising:

a body having a base adapted to operatively engage the suspension spring of the truck, a wall adapted to operatively engage the bolster of the truck, and a front wall including a pocket, said pocket having a bottom wall and a side wall extending outwardly from said bottom wall; and a wear member adapted to be removably located within said pocket of said body, said wear member including a wear pad having a first wall adapted to be located within said pocket adjacent said bottom wall of said pocket, and a second wall adapted to slidably engage the side frame of the truck;

whereby said wear pad is selectively removable from said pocket of said body.

2. The friction wedge of claim 1 wherein said side wall of said pocket extends substantially around the perimeter of said bottom wall of said body.

3. The friction wedge of claim 2 wherein said side wall of said pocket includes a notch adapted to provide access to said wear pad for removing said wear pad from said pocket.

4. The friction wedge of claim 1 wherein said side wall of said pocket includes a rim and said second wall of said wear pad is located outwardly beyond said rim of said side wall of said pocket when said wear pad is located within said pocket.

5. The friction wedge of claim 1 wherein said side wall of said pocket includes a rim and an interior surface, said interior surface sloping outwardly as said interior surface extends from said bottom wall of said pocket to said rim of said side wall.

6. The friction wedge of claim 1 wherein said bottom wall of said pocket and said first wall of said wear pad are each at least partially non-planar.

7. The friction wedge of claim 1 wherein said bottom wall of said pocket and said first wall of said wear pad are generally complimentarily-shaped with respect to one another.

8. The friction wedge of claim 1 wherein said bottom wall of said pocket is at least partially generally concavely curved and said first wall of said wear pad is at least partially generally convexly curved.

9. The friction wedge of claim 1 wherein said bottom wall of said pocket is at least partially generally convexly curved and said first wall of said wear pad is at least partially generally concavely curved.

10. The friction wedge of claim 1 wherein said bottom wall of said pocket includes a generally concavely curved portion and a generally convexly curved portion, and said first wall of said wear pad includes a generally concavely curved portion and a generally convexly curved portion.

11. The friction wedge of claim 1 wherein said side wall of said pocket is adapted to extend substantially around said wear pad and to be located adjacent to said wear pad when said wear pad is located in said pocket.

12. The friction wedge of claim 1 wherein said first wall of said wear pad is adapted to extend substantially coextensively with said bottom wall of said pocket.

13. The friction wedge of claim 1 wherein said wear pad includes a side wall extending between said first wall and said second wall of said wear pad, said side wall of said wear pad sloping inwardly as said side wall extends from said second wall to said first wall of said wear pad.

14. The friction wedge of claim 1 including means for removably retaining said wear pad within said pocket.

15. The friction wedge of claim 1 wherein said wear member includes an adhesive layer located on said wear pad adapted to removably attach said wear pad to said body.

16. The friction wedge of claim 15 wherein said wear member includes a liner removably attached to said adhesive layer, said liner being removable from said adhesive layer prior to inserting said wear pad into said pocket.

17. The friction wedge of claim 1 wherein said wear member includes a backing member attached to said first wall of said wear pad, said backing member adapted to be inserted into said pocket of said body.

18. The friction wedge of claim 17 wherein said backing member includes one or more tabs located adjacent to a peripheral side wall of said wear pad.

19. The friction wedge of claim 17 wherein said wear member includes an adhesive layer located on said backing member adapted to removably attach said backing member to said bottom wall of said pocket.

20. The friction wedge of claim 1 wherein said bottom wall of said pocket includes a recess and said wear member includes a protrusion adapted to be inserted into said recess.

21. A friction wedge for a railroad car truck having a bolster, a suspension spring, and a side frame, said friction wedge comprising:

a body having a base adapted to operatively engage the suspension spring of the truck, a wall adapted to operatively engage the bolster of the truck, and a front wall including a pocket, said pocket having a bottom wall and a side wall extending outwardly from said bottom wall; and a wear member adapted to be removably located within said pocket of said body, said wear member including a wear pad having a first wall adapted to be located adjacent said bottom wall of said pocket, a second wall adapted to slidably engage the side frame of the truck, and an adhesive layer adapted to removably attach said wear pad to said body;

whereby said wear pad is selectively removable from said pocket of said body.

22. The friction wedge of claim 21 wherein said wear member includes a backing member attached to said first side wall of said wear pad, said backing member adapted to be inserted into said pocket of said body, said adhesive layer being located on said backing member for removably attaching said backing member and said wear pad to said body.

23. The friction wedge of claim 21 wherein said wear member includes a liner removably attached to said adhesive layer, said liner being removable from said adhesive layer prior to inserting said wear member into said pocket.

24. A friction wedge for a railroad car truck having a bolster, a suspension spring, and a side frame, said friction wedge comprising:

a body having a base adapted to operatively engage the suspension spring of the truck, a wall adapted to operatively engage the bolster of the truck, and a front wall including a pocket, said pocket having a bottom wall and a side wall extending outwardly from said bottom wall, said side wall of said pocket including a notch; and a wear member adapted to be removably located within said pocket of said body, said wear member including a wear pad having a first wall adapted to be located adjacent said bottom wall of said pocket, and a second wall adapted to slidably engage the side frame of the truck;

whereby said wear pad is selectively removable from said pocket of said body and said notch provides access to said wear pad for removing said wear pad from said pocket.

25. The friction wedge of claim 24 wherein said side wall of said pocket extends along the perimeter of said bottom wall of said body.

* * * * *